US010252564B2

(12) United States Patent
Jang

(10) Patent No.: US 10,252,564 B2
(45) Date of Patent: Apr. 9, 2019

(54) PAPER CLIP

(71) Applicant: Keum Tae Jang, Sejong (KR)

(72) Inventor: Keum Tae Jang, Sejong (KR)

( * ) Notice: Subject to any disclaimer, the term of this patent is extended or adjusted under 35 U.S.C. 154(b) by 30 days.

(21) Appl. No.: 15/300,032

(22) PCT Filed: Jun. 10, 2015

(86) PCT No.: PCT/KR2015/005826
§ 371 (c)(1),
(2) Date: Sep. 28, 2016

(87) PCT Pub. No.: WO2015/199361
PCT Pub. Date: Dec. 30, 2015

(65) Prior Publication Data

US 2017/0157975 A1 Jun. 8, 2017

(30) Foreign Application Priority Data

Jun. 24, 2014 (KR) ..... 10-2014-0077688

(51) Int. Cl.
*B42F 1/00* (2006.01)
*B42F 1/02* (2006.01)

(52) U.S. Cl.
CPC ..... *B42F 1/006* (2013.01); *B42F 1/02* (2013.01)

(58) Field of Classification Search
CPC ..... B42F 1/006; B42F 1/02
See application file for complete search history.

(56) References Cited

U.S. PATENT DOCUMENTS 1,012,594 A * 12/1911 Cain et al. ..... A61M 16/0666 24/338
1,275,582 A * 8/1918 Mascellino ..... A61M 16/0666 24/338
2,267,331 A * 12/1941 Reinhard ..... A44B 99/00 24/538

(Continued)

FOREIGN PATENT DOCUMENTS

| | | |
|---|---|---|
| CN | 202507720 | 10/2012 |
| KR | 200298533 | 12/2002 |
| KR | 100838465 | 6/2008 |

OTHER PUBLICATIONS

International Search Report—PCT/KR2015/005826 dated Aug. 19, 2015.

*Primary Examiner* — Robert Sandy
*Assistant Examiner* — Louis A Mercado
(74) *Attorney, Agent, or Firm* — Cantor Colburn LLP

(57) ABSTRACT

Provided is a paper clip. The paper clip includes: a paper fixing part having a base plate and a clip coupled to the base plate to fix sheets of paper to the base plate; and a fixture for fixing the paper fixing part thereto in such a manner as to allow the base plate to be separably disposed therefrom. The base plate has locking protrusions formed protrudingly from both end portions of one side thereof, and the fixture has locking hooks adapted to separably support the locking protrusions thereagainst. The base plate has a fixing protrusion formed on the region where the locking protrusions are formed, and the fixture has a fixing groove formed on a position corresponding to the fixing protrusion in such a manner as to fixedly insert the fixing protrusion thereinto.

8 Claims, 6 Drawing Sheets

(56) References Cited

U.S. PATENT DOCUMENTS

| | | | | | |
|---|---|---|---|---|---|
| 2,994,116 | A * | 8/1961 | Anderson | A44B 6/00 | 24/66.13 |
| 3,030,681 | A * | 4/1962 | Phillips | G09F 3/16 | 24/331 |
| 3,267,546 | A * | 8/1966 | Kraft | B42F 1/06 | 211/50 |
| 3,805,813 | A * | 4/1974 | Laughton | A45D 8/24 | 132/279 |
| 4,241,477 | A * | 12/1980 | Freedom | B42F 1/02 | 24/67 P |
| 4,967,453 | A * | 11/1990 | MacDonald | B42F 1/02 | 150/137 |
| 5,022,124 | A * | 6/1991 | Yiin | B42F 1/08 | 24/546 |
| 5,086,545 | A * | 2/1992 | Suzuki | B42F 1/02 | 24/346 |
| 5,651,522 | A | 7/1997 | Davis et al. | | |
| 5,845,889 | A | 12/1998 | Suzuki | | |
| 2002/0162933 | A1* | 11/2002 | Assayah | B42F 1/02 | 248/316.7 |
| 2004/0216283 | A1* | 11/2004 | Cassaday | B42F 1/02 | 24/67.5 |
| 2005/0244213 | A1 | 11/2005 | Carmen et al. | | |
| 2012/0260466 | A1* | 10/2012 | Yoshida | B42F 1/006 | 24/67.7 |
| 2012/0279019 | A1* | 11/2012 | Cassaday | B42F 1/006 | 24/67.5 |

* cited by examiner

PAPER CLIP

TECHNICAL FIELD

The present invention relates to a paper clip, and more particularly, to a paper clip that is capable of being made according to the number of sheets of paper and that is capable of fixing sheets of paper having a given thickness thereto in a convenient way.

BACKGROUND ART

Generally, clips having various shapes are used to temporarily fix an object to be fixed such as sheets of paper, documents, and so on thereto.

In conventional practices, a wire clip has been widely used, and the wire clip is made by bending a steel wire having given elasticity to a given shape to form two large and small curved portions so that an object to be fixed is insertedly fixed to the space between the curved portions. According to the conventional wire clip, however, it is hard to fix the object having a given thickness value of more than a given value, and further, the wire clip is easily deformed so that it cannot be returned to its original state.

So as to solve the above-mentioned problems, there is proposed another type of clip having a clip part made of a plate-shaped member bent to a shape of "ㄴ" and a handle part mounted on the clip part. In this case, however, it is difficult to stackingly keep a plurality of objects to be fixed thereto due to the volume occupied by the handle part of the conventional clip.

On the other hand, a Nalclip (which is the name of a product, but is used as a generic trademark) has a strong pressurizing force, and accordingly, it is hard to directly fix the Nalclip to an object to be fixed, so that the Nalcip is fixed using a Nalclip dispenser, thereby making it inconvenient in use.

PRIOR ART DOCUMENTS

Patent Document (Patent Document 1) Korean Utility Model Registration No. 20-0298533 (Sato Hisao) Dec. 6, 2002

DISCLOSURE

Technical Problem

Accordingly, the present invention has been made in view of the above-mentioned problems occurring in the prior art, and it is an object of the present invention to provide a paper clip that is capable of being made according to the number of sheets of paper and that is capable of fixing sheets of paper having a given thickness thereto in a convenient way.

Technical Solution

To accomplish the above-mentioned object, according to the present invention, there is provided a paper clip including: a paper fixing part having a base plate and a clip coupled to the base plate to fix sheets of paper to the base plate; and a fixture for fixing the paper fixing part thereto in such a manner as to allow the base plate to be separably disposed therefrom.

According to the present invention, desirably, the base plate has locking protrusions formed protrudingly from both end portions of one side thereof, and the fixture has locking hooks adapted to separably support the locking protrusions thereagainst.

According to the present invention, desirably, the base plate has a fixing protrusion formed on the region where the locking protrusions are formed, and the fixture has a fixing groove formed on a position corresponding to the fixing protrusion in such a manner as to fixedly insert the fixing protrusion thereinto.

According to the present invention, desirably, the clip includes: a base sheet rotatably coupled to the base plate; an inclined sheet inclinedly extended upwardly from the base sheet; and a support sheet inclinedly extended from the inclined sheet toward the base plate and having an end portion bent.

According to the present invention, desirably, the paper clip further includes an elastic support detachably coupled to the base plate and having a larger width than the base plate.

According to the present invention, desirably, the fixture includes: a bottom; a wall extended from the bottom; and a ceiling extended from the wall and having an advertisement display part formed thereon.

According to the present invention, desirably, the elastic support includes: an elastic base plate detachably disposed on the underside of the base plate; and an elastic slant plate extended from one end portion of the elastic base plate toward the upward direction of the base plate in such a manner as to be free on one end portion thereof, without being fixed.

According to the present invention, desirably, the fixture includes: a bottom having locking hooks adapted to lockingly support locking protrusions of the base plate thereagainst; a wall extended from the bottom; and a ceiling extended from the wall and having an advertisement display part formed thereon.

According to the present invention, desirably, one pair of locking hooks is disposed on both sides of the bottom in a width direction thereof over almost the whole length of the bottom.

Advantageous Effects

According to the present invention, the paper clip is configured wherein the clip is bendingly disposed on the base plate so that the sheets of paper having a given thickness can be conveniently fixed to the space between the clip and the fixture.

Further, the paper clip according to the present invention is configured wherein the paper fixing part to which the sheets of paper having the given thickness is fixed is detachably coupled to the fixture so that the sheets of paper can be more conveniently and stably fixed to the paper clip of the present invention.

BEST MODE FOR INVENTION

Figure 1:
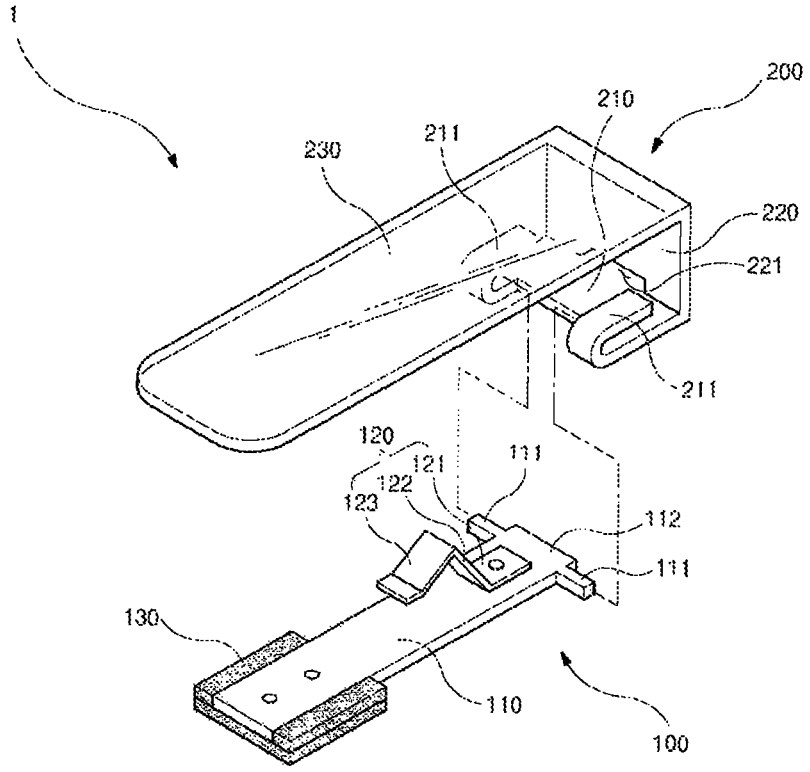
FIG. 1 is an exploded perspective view showing a paper clip according to a first embodiment of the present invention.

First, a paper clip according to the present invention will be explained with reference to the attached drawings so as to make the advantages of the operations of the paper clip of the present invention and the objects accomplished by the present invention substantially understood.

Hereinafter, an explanation on the paper clip according to the preferred embodiments of the present invention will be in detail given with reference to the attached drawings. In the description, it should be noted that the parts corresponding to those of the drawings are indicated by corresponding reference numerals.

FIG. 1 is an exploded perspective view showing a paper clip according to a first embodiment of the present invention.

As shown, the paper clip 1 according to the first embodiment of the present invention includes a paper fixing part 100 adapted to fix sheets of paper having a given thickness thereto and a fixture 200 adapted to separably couple the paper fixing part 100 thereto.

The paper fixing part 100 serves to fix the sheets of paper having the given thickness thereto, and as shown in FIG. 1, the paper fixing part 100 has a base plate 110, a clip 120 rotatably coupled to the base plate 110 to fix the sheets of paper having the given thickness to the base plate 110, and an elastic support 130 separably coupled to the base plate 110 and provided as a holding place for a user.

As shown in FIG. 1, the base plate 110 of the paper fixing part 100 is made to a form of a rectangular long and thin plate. Further, locking protrusions 111 are formed protrudingly from both sides of one end portion of the base plate 110 of the paper fixing part 100, and they are lockedly supported against locking hooks 211 of the fixture 200.

Furthermore, as shown in FIG. 1, a fixing protrusion 112 is formed on the region of the base plate 110 where the locking protrusions 111 are formed, and the fixing protrusion 112 is insertedly supported against a fixing groove 221 formed on the fixture 200.

According to the present invention, the base plate 110 is made of a plastic material.

As shown in FIG. 1, the clip 120 of the paper fixing part 100 has a base sheet 121 rotatably coupled to the top surface of the base plate 110, an inclined sheet 122 inclinedly extended upwardly from the base sheet 121, and a support sheet 123 inclinedly extended from the inclined sheet 122 toward the base plate 110 and having an end portion bent.

According to the present invention, the base sheet 121 is separably screw-coupled to the base plate 110.

According to the present invention, the clip 120 is bent to have an elastic force generated from the shape itself thereof, and also, the end portion of the support sheet 123 is bent to pressurize the underside surfaces of the sheets of paper P having the given thickness over a relatively large area thereof.

According to the present invention, further, the clip 120 is detachably coupled to the base plate 110, so that the paper clip of the present invention can be permanently used through the exchange of the clip 120 with new one.

As shown in FIG. 1, the elastic support 130 of the paper fixing part 100 has a recess formed thereon so that the top surface of the base plate 110 has the same height as the top surface of the elastic support 130. Accordingly, the formation of the elastic support 130 prevents the undersides of the sheets of paper fixed to the base plate 110 from being distorted.

According to the present invention, the elastic support 130 is made of a rubber material.

The fixture 200 serves to stably support the paper fixing part 100 to which the sheets of paper having the given thickness is fixed and also serves to conveniently separate the paper fixing part 100 fixed thereto therefrom.

According to the present invention, as shown in FIG. 1, the fixture 200 includes a bottom 210 having the pair of locking hooks 211 spaced apart from each other, a wall 220 formed on the rear side of the bottom 210 when viewed with respect to FIG. 1, and a ceiling 230 formed on the top end portion of the wall 220.

The pair of locking hooks 211 disposed on the bottom 210 of the fixture 200 is adapted to allow the locking protrusions 111 of the base plate 110 to be fixedly inserted thereinto.

As shown in FIG. 1, the wall 220 of the fixture 200 has a fixing groove 221 formed thereon in such a manner as to insert the fixing protrusion 112 of the base plate 110 thereinto.

As shown in FIG. 1, the ceiling 230 of the fixture 200 has a substantially longer length than the base plate 110 of the paper fixing part 100, and further, the ceiling 230 has an advertisement display part such as characters, logos, and marks formed thereon.

According to the present invention, the advertisement display part is disposed on the external surface of the ceiling 230 of the fixture 200, thereby improving the visibility thereof.

According to the present invention, unlike the fixture 200 having a bent shape, the paper fixing part 100 has a flat shape, thereby ensuring a good outer appearance of the paper clip, and the clip 120 is disposed only on the base plate 110, thereby remarkably reducing the thickness of the paper clip of the present invention.

Figure 2:
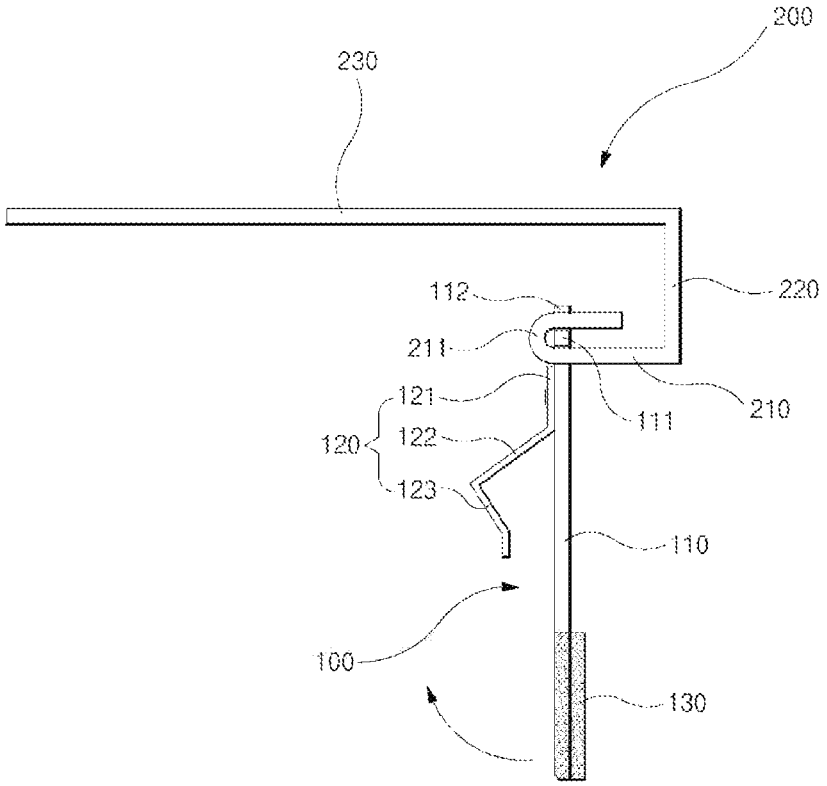
FIG. 2 is a side view showing the state wherein locking protrusions of a paper fixing part are lockedly supported against locking hooks of a fixture in the paper clip of FIG. 1.
Figure 3:
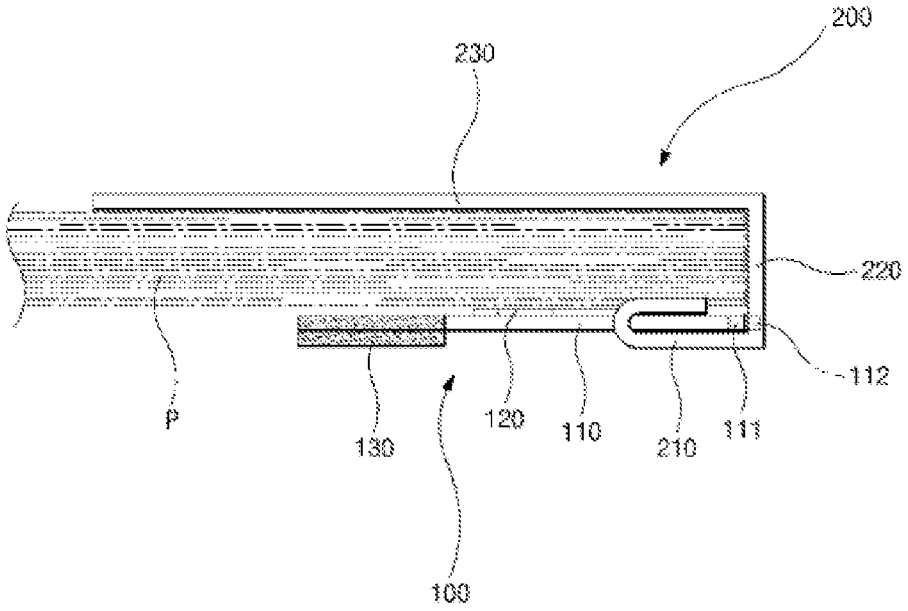
FIG. 3 is a schematic side view showing the state wherein sheets of paper having a given thickness are fixed to the paper clip according to the first embodiment of the present invention.

FIG. 2 is a side view showing the state wherein the locking protrusions of the paper fixing part are lockedly supported against the locking hooks of the fixture in the paper clip of FIG. 1, and FIG. 3 is a schematic side view showing the state wherein the sheets of paper having the given thickness are fixed to the paper clip according to the first embodiment of the present invention.

Hereinafter, an explanation on the use state of the paper clip according to the first embodiment of the present invention will be briefly given with reference to FIGS. 2 and 3.

Before the sheets of paper P having the given thickness are fitted to the paper clip 1, the fixing protrusion 112 of the base plate 110 becomes in a drawn state from the fixing groove 221 of the fixture 200, and as shown in FIG. 2, the locking protrusions 111 of the base plate 110 are supported against the locking hooks 211 of the fixture 200 so that the ceiling 230 of the fixture 200 and the base plate 110 are disposed in a perpendicular relationship to each other to have a shape of "¬".

Next, the sheets of paper P are fitted to the underside of the ceiling 230 of the fixture 200, and after that, if the base plate 110 is lifted up in a direction of an arrow as shown in FIG. 2, the sheets of paper P are supportedly located between the clip 120 and the ceiling 230 of the fixture 200.

In this state, if the fixing protrusion 112 of the base plate 110 is fitted to the fixing groove 221 of the fixture 200, the sheets of paper P are fixed by means of the clip 120.

Figure 4:
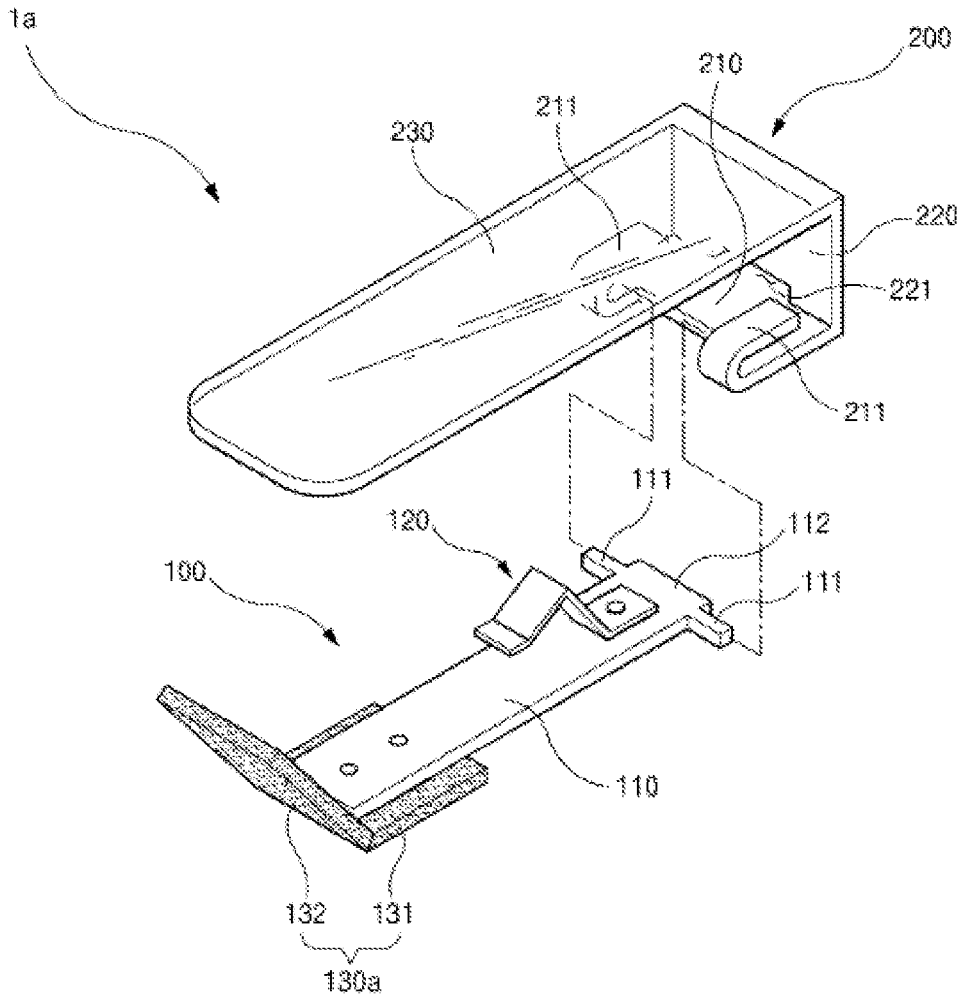
FIG. 4 is an exploded perspective view showing a paper clip according to a second embodiment of the present invention.
Figure 5:
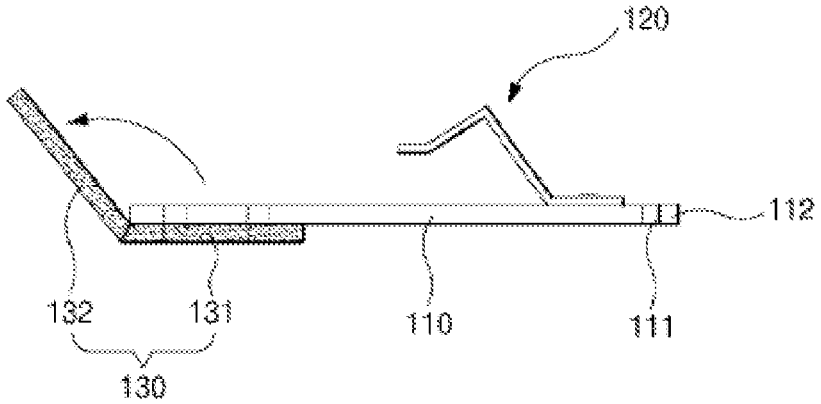
FIG. 5 is a side view showing a paper fixing part of the paper clip of FIG. 4.

FIG. 4 is an exploded perspective view showing a paper clip according to a second embodiment of the present invention, and FIG. 5 is a side view showing a paper fixing part of the paper clip of FIG. 4.

As shown in FIGS. 4 and 5, a paper clip 1*a* according to the second embodiment of the present invention is different from the paper clip 1 according to the first embodiment of the present invention in that it has a bent elastic support 130*a*.

As shown in FIGS. 4 and 5, the elastic support 130*a* has an elastic base plate 131 detachably disposed on the underside of the base plate 110 and an elastic slant plate 132 extended from one end portion of the elastic base plate 131 toward the upward direction of the base plate 110 in such a manner as to be free on one end portion thereof, without being fixed.

The elastic slant plate 132 of the elastic support 130*a*, which is a portion pressed by a user's hand, is made of a rubber material having its own elastic force, so that it can pressurize the sheets of paper having a given thickness thereagainst, together with the clip 120, thereby improving the force for fixing the sheets of paper to the paper clip 1*a*.

In addition to the rubber material, according to the present invention, the elastic slant plate 132 may be made of soft materials like plastic.

Figure 6:
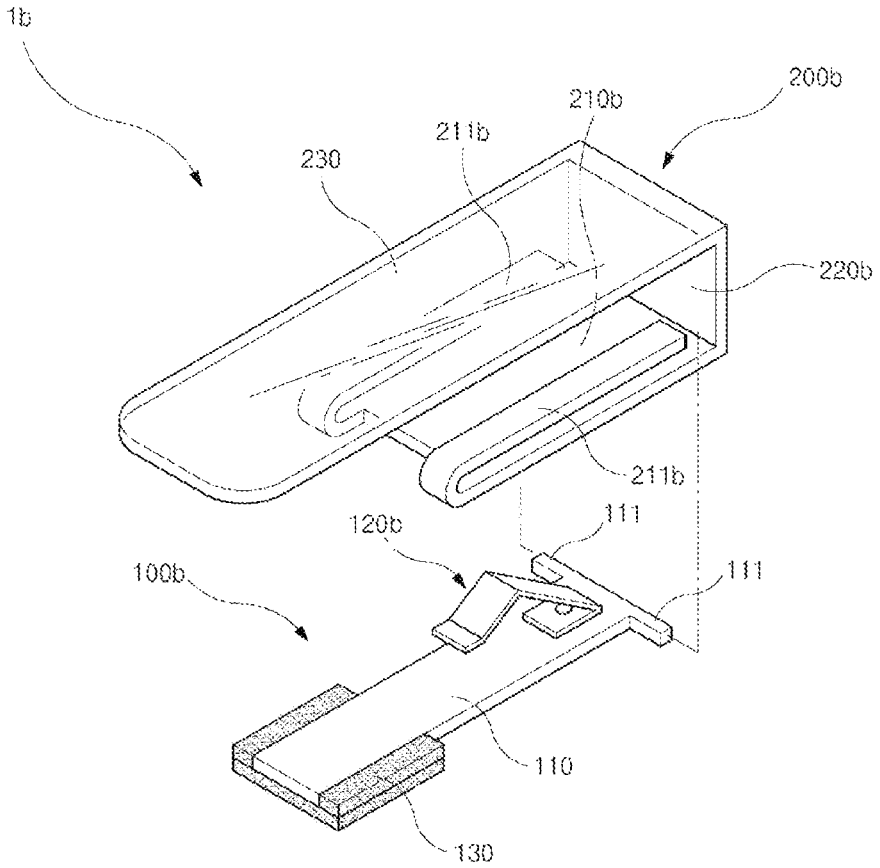
FIG. 6 is an exploded perspective view showing a paper clip according to a third embodiment of the present invention.

FIG. 6 is an exploded perspective view showing a paper clip according to a third embodiment of the present invention.

A paper clip 1*b* according to the third embodiment of the present invention is different from the paper clips 1 and 1*a* according to the first and second embodiments of the present invention in that a clip 120*b* of a paper fixing part 100*b* is changed in shape and a fixture 200*b* is also changed in shape.

The clip 120*b* of the paper fixing part 100*b* is configured to have a base sheet 121 located in the opposite direction to the base sheet 121 of the clip 120 as mentioned above. In this case, advantageously, the space occupied by the clip 120*b* in the longitudinal direction of the base plate 110 can be reduced.

As shown in FIG. 6, the fixture 200*b* includes a bottom 210*b* having locking hooks 211*b* adapted to lockingly support the locking protrusions 111 of the base plate 110 thereagainst, a wall 220*b* extended from the bottom 210*b*, and a ceiling 230 extended from the wall 220*b*, and the ceiling 230 has the above-mentioned advertisement display part formed thereon.

According to the present invention, one pair of locking hooks 211*b* is disposed on both sides of the bottom 210*b* in the width direction thereof over almost the whole length of the bottom 210*b*, so that the moving distance of the base plate 110 having the clip 120*b* mounted thereon is extended further to allow the range of the thickness of the sheets of paper fixed to the paper clip 1*b* to be increased.

As mentioned above, the paper clip according to the preferred embodiments of the present invention is configured wherein the clip is bendingly disposed on the base plate so that the sheets of paper having a given thickness can be conveniently fixed to the space between the clip and the fixture.

Further, the paper clip according to the preferred embodiments of the present invention is configured wherein the paper fixing part to which the sheets of paper having the given thickness is fixed is separably coupled to the fixture so that the sheets of paper can be more conveniently and stably fixed to the paper clip of the present invention.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A paper clip comprising:

a paper fixing part having a base plate and a clip coupled to the base plate to fix sheets of paper to the base plate;

a fixture for fixing the paper fixing part thereto in such a manner as to allow the base plate to be disposed therefrom; and an elastic support coupled to the base plate and having a larger width than the base plate, wherein the base plate has locking protrusions formed protrudingly from both end portions of one side thereof, and the fixture has locking hooks adapted to separably support the locking protrusions thereagainst, and wherein the base plate has a fixing protrusion formed on a region where the locking protrusions are formed, and the fixture has a fixing groove formed on a position corresponding to the fixing protrusion in such a manner as to fixedly insert the fixing protrusion thereinto.

2. The paper clip according to claim 1, wherein the clip comprises:

a base sheet coupled to the base plate;

an inclined sheet inclinedly extended upwardly from the base sheet; and a support sheet inclinedly extended from the inclined sheet toward the base plate and having an end portion bent.

3. The paper clip according to claim 1, wherein the fixture comprises:

a bottom;

a wall extended from the bottom; and a ceiling extended from the wall and having an advertisement display part formed thereon.

4. The paper clip according to claim 1, wherein the elastic support comprises:

an elastic base plate disposed on underside of the base plate; and an elastic slant plate extended from one end portion of the elastic base plate toward upward direction of the base plate in such a manner as to be free on one end portion thereof, without being fixed.

5. The paper clip according to claim 1, wherein the fixture comprises:

a bottom having locking hooks adapted to lockingly support locking protrusions of the base plate thereagainst;

a wall extended from the bottom; and a ceiling extended from the wall and having an advertisement display part formed thereon.

6. The paper clip according to claim 5, wherein one pair of locking hooks is disposed on both sides of the bottom in a width direction thereof over almost a whole length of the bottom.

7. A paper clip comprising:

a paper fixing part having a base plate and a clip coupled to the base plate to fix sheets of paper to the base plate;

a fixture for fixing the paper fixing part thereto in such a manner as to allow the base plate to be disposed therefrom; and an elastic support coupled to the base plate and having a larger width than the base plate, wherein the elastic support comprises:

an elastic base plate disposed on underside of the base plate; and an elastic slant plate extended from one end portion of the elastic base plate toward upward direction of the base plate in such a manner as to be free on one end portion thereof, without being fixed.

8. A paper clip comprising:

a paper fixing part having a base plate and a clip coupled to the base plate to fix sheets of paper to the base plate; and a fixture for fixing the paper fixing part thereto in such a manner as to allow the base plate to be disposed therefrom, wherein the base plate has locking protrusions formed protrudingly from both end portions of one side thereof, and the fixture has locking hooks adapted to separably support the locking protrusions thereagainst, wherein the base plate has a fixing protrusion formed on a region where the locking protrusions are formed, and the fixture has a fixing groove formed on a position corresponding to the fixing protrusion in such a manner as to fixedly insert the fixing protrusion thereinto, wherein the fixture comprises: a bottom having locking hooks adapted to lockingly support locking protrusions of the base plate thereagainst; a wall extended from the bottom; and a ceiling extended from the wall and having an advertisement display part formed thereon, and wherein one pair of locking hooks is disposed on both sides of the bottom in a width direction thereof over almost a whole length of the bottom.

* * * * *